United States Patent [19]

Halvorson et al.

[11] 4,077,338

[45] Mar. 7, 1978

[54] SHAFT FURNACE FOR PYROLYSIS OF REFUSE WITH BED SUPPORT STRUCTURE

[75] Inventors: Thomas Gilbert Halvorson, Lockport; Edward Paul Eardley, Getzville, both of N.Y.

[73] Assignee: Union Carbide Corporation, New York, N.Y.

[21] Appl. No.: 711,789

[22] Filed: Aug. 5, 1976

[51] Int. Cl.[2] ..... F23G7/00

[52] U.S. Cl. ..... 110/235

[58] Field of Search ..... 110/8 R, 8 B, 11, 17, 110/18 R, 18 C; 202/120

[56] References Cited

U.S. PATENT DOCUMENTS

| | | | |
|---|---|---|---|
| 143,487 | 10/1873 | Andrews | 110/17 |
| 1,403,243 | 1/1922 | Helseth | 110/17 |
| 3,330,230 | 7/1967 | Sasaki | 110/17 |
| 3,408,968 | 11/1968 | Pantoja | 110/17 |
| 3,777,676 | 12/1973 | Lagen | 110/11 |

*Primary Examiner*—Kenneth W. Sprague
*Attorney, Agent, or Firm*—Lawrence G. Kastriner; Warrick E. Lee, Jr.

[57] ABSTRACT

A vertical shaft furnace for the pyrolysis of pelletized refuse, having a hearth in the base provided with a refuse bed support structure comprising a plurality of cooled, refractory support members, extending radially inward from the wall toward the axis of the hearth. The support structure is characterized by having a plurality of peripheral spaces extending through side structure and converging in the downward direction, each of the peripheral spaces being formed, at least in part, by the side wall surfaces of adjacent support members and the inside surface of the hearth.

12 Claims, 9 Drawing Figures

FIG. 3
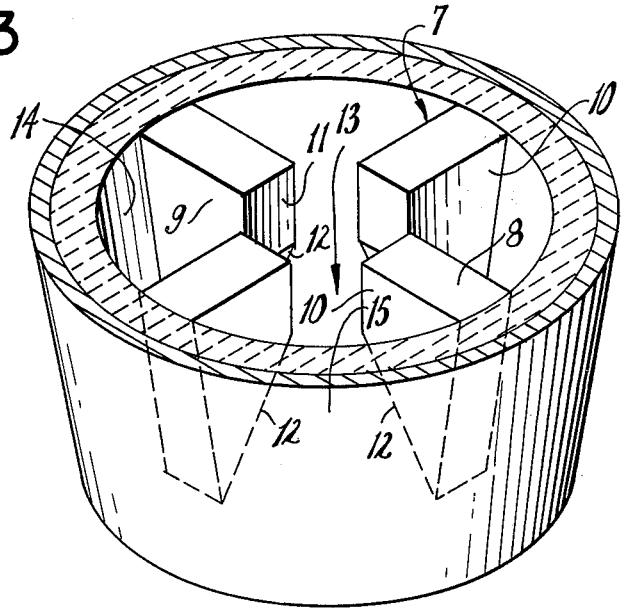
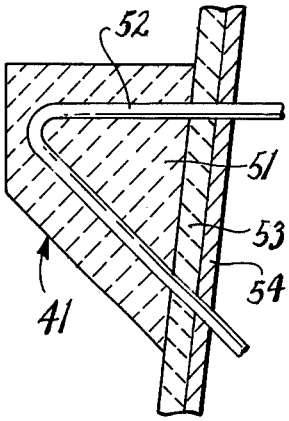
FIG. 5
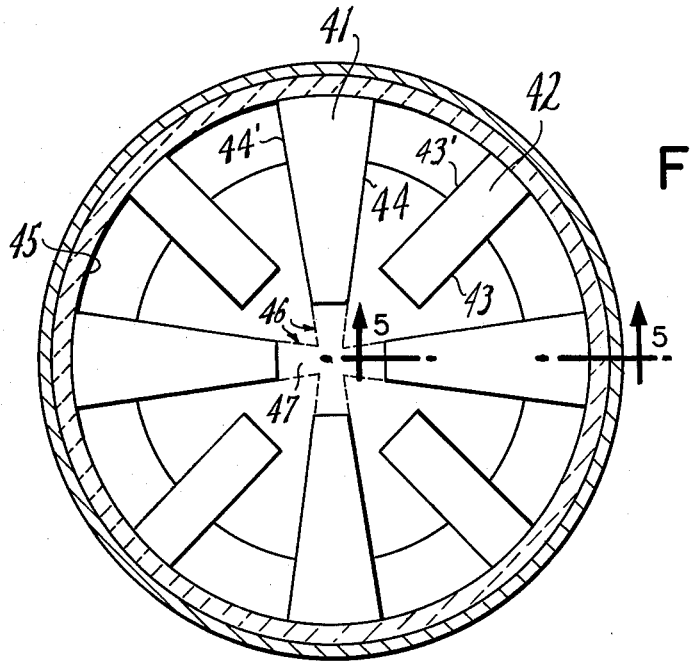
FIG. 4

SHAFT FURNACE FOR PYROLYSIS OF REFUSE WITH BED SUPPORT STRUCTURE

BACKGROUND

This invention relates in general to apparatus for the disposal of solid waste and the recovery of valuable resources therefrom, and more particularly to an improved vertical shaft furnace or converter for the pyrolysis of refuse.

In an effort to solve ecological problems caused by prior methods of disposing of solid waste, and a desire to recover as much as possible of the natural resources contained in the waste, a process, described and claimed in U.S. Pat. No. 3,729,298, was developed by Anderson. In summary, the Anderson process comprises feeding refuse into the top and oxygen into the base of a vertical shaft furnace. The furnace (or converter) is best described in terms of having three functional zones; a drying zone at the top, a thermal decomposition or pyrolysis zone in the middle, and a combustion and melting zone (or hearth) at the base. It is to be understood that these functional zones are not clearly distinct. That is, there is no sharp line separating them and they may move somewhat during operation. As the refuse descends in the furnace, it is first dried by the hot gas which rise through the furnace, and then pyrolyzed. Pyrolysis is a process whereby organic matter in the refuse is decomposed and thermally cracked in an oxygen-deficient atmosphere with the generation of a CO, $H_2$ and a char like material. As the refuse moves down through the pyrolysis zone, it is converted in part to volatile materials which rise, and in part to char which descends into the hearth. There it is combusted with oxygen, causing the generation of carbon monoxide, carbon dioxide and the heat required to melt the inorganic solids in the refuse, such as glass and metal. The resulting molten "slag" is continuously tapped from the hearth and quenched in a water tank. A gas mixture containing at least 50% CO and $H_2$ (on a dry basis) is discharged from the top of the furnace. Following cleanup, the gas may be used as a medium BTU fuel gas or as raw material for chemical synthesis. Apparatus suitable for carrying out the Anderson process described above is shown in U.S. Pat. No. 3,801,082, the disclosure of which is incorporated herein by reference.

It has been found that to efficiently and continuously process shredded refuse through a shaft furnace, it is necessary to form pellets from the refuse before feeding it into the furnace in order to prevent the shredded refuse from compacting so tightly as to unduly restrict the flow of gases through the shaft. The specific characteristics of the refuse pellets required for smooth, long term operation are described in Anderson's copending commonly assigned U.S. application Ser. No. 675,935 filed Apr. 12, 1976 now U.S. Pat. No. 4,042,345, the disclosure of which is incorporated herein by reference. Suitable pellets are characterized by Anderson as having:

1. a density greater than that given by the equation:

$$D = (2{,}000/(100-0.8A))$$

where:

$D$ = the density of the pellet (lbs/cu.$^3$), $A$ = percent inorganics in the refuse pellet, and 2. a surface to volume ratio greater than that given by the equation:

$$R = 15(G/H)^{0.625}$$

where:

$R$ = the ratio of the surface area to the volume of the pellet (ft.$^2$/ft.$^3$)

$H$ = the height of the refuse bed in the furnace (ft.)

$G$ = the refuse feed rate (tons/day/ft.$^2$ of furnace cross-sectional area).

It has been found that when operating shaft furnaces of the type described in U.S. Pat. No. 3,801,082 with a pelletized refuse feed, sudden upsets or fluctuations beyond normal operating limits tend to arise periodically in the operating characteristics of the furnace. These upsets are believed to be caused by periodic collapse of the refuse bed above the hearth and lack of adequate gas mixing and distribution in the furnace.

In order to overcome the above problems, it was decided to provide means to support the bed of refuse pellets in the shaft furnace. Such support means must, however, be capable of withstanding the high temperature of the hearth (approximately 3000° F), the highly oxidizing conditions in the base of the furnace, as well as the varying composition of the refuse which causes varying products to be produced. These represent a harsh, corrosive environment to the support means.

Bed support structures are known to be used in coal gasification furnaces as well as in gas cupola furnaces.

Secord, in U.S. Pat. No. 3,253,906 discloses the use of water cooled grates in a coal gasification furnace, wherein a bed of lump bituminous coal is supported on a grate comprising hollow steel pipes extending transversely across the furnace through which a cooling medium is passed. Combustion of the coal takes place above the grate, with the solids remaining on the top of the grate and only the molten products produced being permitted to flow through it.

The use of a supporting grid formed by horizontal hollow steel bars covered with a refractory material is also disclosed in the cupola oxygen furnace shown by Taft et al in U.S. Pat. No. 3,802,678. Resting on these bars is a bed of spherical refractory balls on which the furnace charge rests. The balls permit the passage of gas and provide sufficient length-of-path and time-of-contact for the descending metal charge to melt and become superheated, so that droplets of metal fall through the supporting grid and collect in a pool in the base of the shaft furnace.

The support structures shown in the above-mentioned prior art patents function to prohibit the passage of solid objects through them, allowing only the molten metal to flow through into the hearth. Such prior art grate structures are unsatisfactory for use in shaft furnaces for the pyrolysis of refuse pellets, since here it is necessary that lumps of char formed from the pellets of refuse in the pyrolysis zone pass through the grate into the hearth where the char is combusted to produce the heat necessary to fluidize the inorganic material, as well as producing sufficient heat and to pyrolyze the organic material in the refuse. At the same time, the pellets of unpyrolyzed refuse should not be permitted to fall into the hearth, since if they did, they would upset the operation of the furnace.

OBJECTS

It is an object of the present invention to provide a shaft furnace for the disposal of refuse and the production of useful fuel gas which is provided with a structure capable of supporting a bed of refuse pellets thereon, but which permits solid lumps of char formed in the pyrolysis zone to pass through the support structure into the conbustion zone in the base of the hearth.

It is another object of this invention to provide a shaft furnace for the pyrolysis of refuse which contains a support structure capable of withstanding the harsh, high temperature conditions in the hearth of the furnace.

SUMMARY

The above and other objects, which will be apparent to those skilled in the art, are achieved by the present invention, which comprises:

in a vertical shaft furnace for the pyrolysis of pelletized refuse, having a drying zone in the upper part, a pyrolysis zone in the mid portion, and a hearth for combustion and melting in the base of said furnace provided with means for supplying oxygen to said hearth, the improvement comprising a refuse bed support structure, said support structure being located in the lower portion of the hearth but above the level of said oxygen supply means, and comprising at least three cooled, refractory support members, extending radially inward from the hearth wall toward the axis of the hearth, and having side wall surfaces, said support structure being characterized by having a plurality of peripheral spaces extending through said structure and converging in the downward direction, each of said peripheral spaces being formed at least in part by the side wall surfaces of adjacent support members and the inside surface of the hearth.

Preferably, the diameter of the largest inscribed circle which fits into a horizontal cross-section of the peripheral spaces in the support structure is smaller than three times the diameter of the as-charged refuse pellets. The diameter of other such inscribed circles decrease in the downward direction.

In a preferred embodiment of the present invention, the members terminate short of the axis, so as to form a central space extending through said support structure. The cross-sectional area of said central space (in the horizontal plane at the top of the support structure) is preferably less than 40% of the total cross-sectional area of the hearth in the same plane.

Another preferred embodiment of the present invention is a shaft furnace having a bed support structure wherein the support members are fixedly attached at their axial ends to a cooled, refractory, toroidal structure, the axis of which is parallel to that of the hearth. The most preferred structure of this design has the surface of said toroidal structure facing its axis frustoconically shaped and converging in the downward direction.

THE DRAWINGS

FIG. 3 is an isometric illustration of the bed support structure shown in FIGS. 1 and 2.

FIG. 4 is a horizontal cross-section at the top surface of a bed support structure, illustrating the use of eight support members of two different sizes.

FIG. 5 is a detail of a support member taken along the center line 5—5 of one of the long support members shown in FIG. 4.

DETAILED DESCRIPTION

Figure 1:
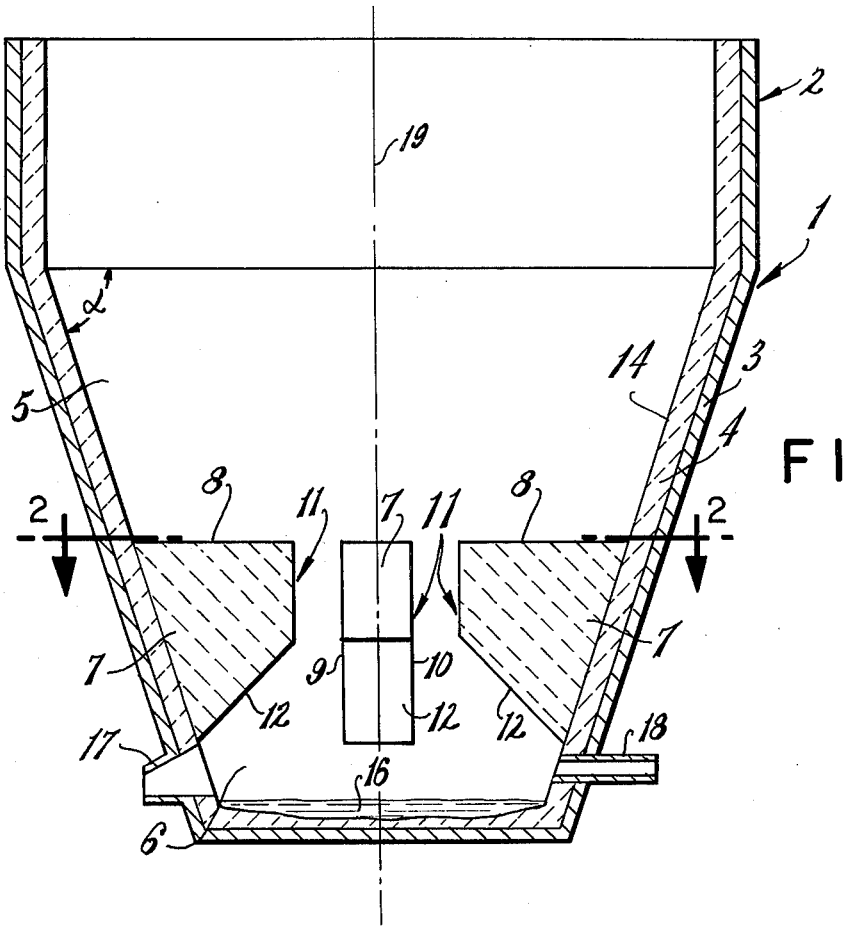
FIG. 1 is a vertical cross-sectional view of the hearth portion of a shaft furnace containing the refuse bed support structure in accordance with a preferred embodiment of the invention.
Figure 2:
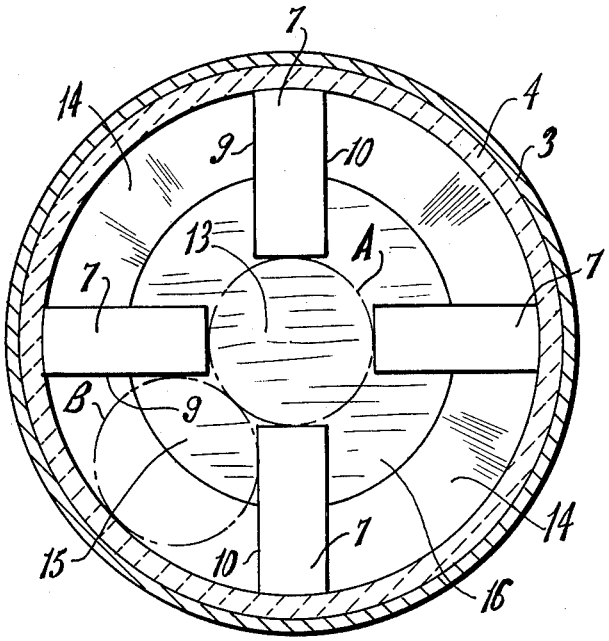
FIG. 2 is a top view taken along line 2—2 of FIG. 1, illustrating in partial cross-section the hearth at the top surface of the bed support structure.

In order to obtain a better understanding of the present invention, reference is made to FIGS. 1, 2 and 3 which illustrate a preferred embodiment of the present invention, wherein a conically shaped hearth is provided with four equally sized, symmetrically spaced, wall mounted support members 7, which together comprise the bed support structure. Hearth 1 of the furnace is attached to the base of a cylindrical shaft 2. Hearth 1 comprises a conical steel shell 3 lined with refractory material 4. Hearth 1 is separated by the support structure, consisting of the four support members 7, into an upper zone 5 and a lower zone 6. Each support member 7 extends radially inward from the wall of the hearth 14, to which it is fixedly attached, and has a horizontal upper face 8, and left and right side wall surfaces 9 and 10 respectively, each of which extend vertically downward and parallel to each other. Each of the support members 7 contains a surface 11 which faces the common axis 19 of the hearth and the support structure. Surface 11 extends vertically downward for a short distance, after which it is inclined toward the wall of the hearth 14 such that it has an inclined surface 12. It will be seen that as a result of the inclination of the surfaces 12, the central space 13 formed by the support members 7 grows larger in horizontal cross-section as it progresses downward. That is, if one were to draw an inscribed circle A in the middle of the space formed by the four support members, as illustrated in FIG. 2, a plurality of such inscribed circles, each in a horizontal plane, would remain constant as one proceeds axially downward over the distance of the surface 11, after which the inscribed circles would increase in diameter as the surface 12 flares outward. Hence, space 13 defined by such inscribed circles form a cylinder which communicates with an outwardly flaring cone. Such shape 13 insures that any char which passes through the top opening in the center of the bed support structure will have free access to the lower portion 6 of the hearth.

Reference to FIG. 2 will show that an inscribed circle B in the horizontal plane in the peripheral space 15 formed by the side walls 9 and 10 of adjacent support members 7 and the wall of the hearth 14 will decrease in size in an axially downward direction due to the fact that the conical hearth wall 14 tapers axially inward. Consequently, each of the spaces 15 converges downward, thereby creating a pinching or wedging action on those pellets which are channeled into spaces 15. Consequently, the support structure acts not only to support the bed of refuse pellets above it by means of the upper surfaces 8 of the support members 7, but also by promoting bridging over the spaces 15. As wedged pellets (not shown) in the support structure are consumed, they will diminish in size until they are able to pass through the peripheral spaces 15 and will then be combusted in the lower hearth zone 6. Oxygen is fed into the lower portion of the hearth 6 through injection tuyeres 18. The inorganic materials are melted in the hearth forming a pool of molten metal and slag 16 which collects in the base of the hearth and flows out through the slag tap 17.

FIG. 4 illustrates an embodiment wherein eight support members are used, four of which 41 are long members, symmetrically located around the periphery of the hearth. Between these there are four equally spaced short support members 42. The side surfaces of the support members 41 and 42 are vertical; surfaces 43 and 43' are parallel to each other, while the side surfaces 44 and 44' flare outwards from the axis toward the wall of the hearth 45.

FIG. 4 also illustrates an alternative arrangement of support members, wherein the long members 41 are extended (by the dotted lines 46) so as to converge in the middle forming the element 47. In such embodiment there is no open space down the center of the support structure, but since the converging element 47 occupies only a small space, sufficient open area may be retained for proper functioning of the support structure.

FIG. 5 illustrates a cross-sectional view taken along line 5—5 of a long support member 41, illustrating the manner in which each of the support members, whether long or short, may be constructed. Each of these support members, as well as those in FIGS. 1–3, is made of a refractory material 51 provided with steel or preferably copper tubing 52 through which water or another cooling medium is circulated for purposes of keeping the support member sufficiently cool to prevent it from being decomposed by the high temperature and corrosive atmosphere within the hearth. The support member 41 is fixedly attached to the refractory wall or lining 53 and metal shell 54 of the hearth. While only a plain cooling water tube 52 is illustrated in FIG. 5, it will be apparent to those skilled in the art that improved heat conduction may be obtained by the application of well known techniques such as attaching metallic, heat conducting fins or fingers (not shown) to the copper tube 52. While water is the preferred cooling medium, any other liquid or gas which is cooler than the temperature of the hearth may be used. Other suitable cooling mediums include air, steam, chlorinated biphenyl or any available process stream which needs to be heated.

Figure 6:
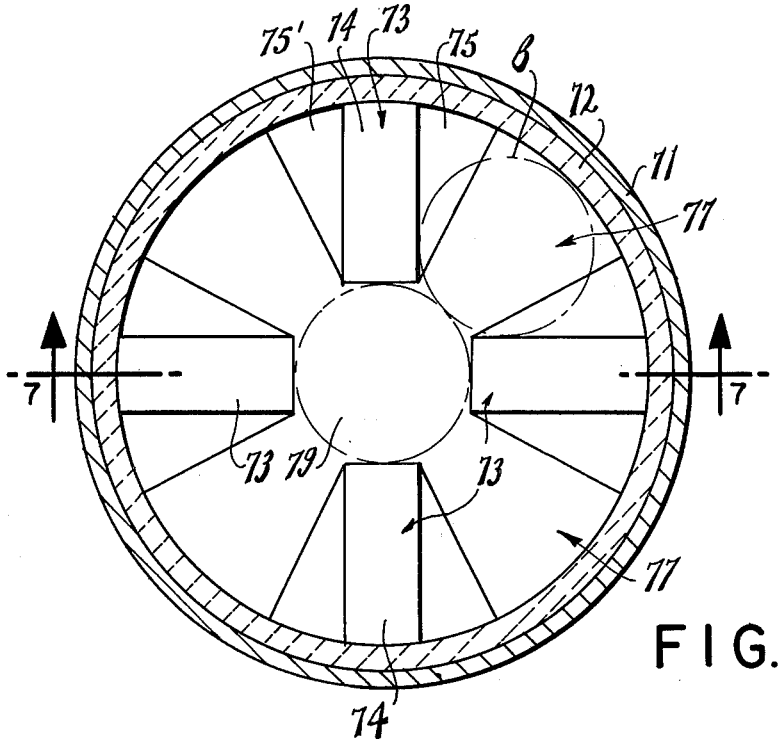
FIG. 6 is a top view of a vertical hearth provided with four bed support members having downwardly flared side walls.
Figure 7:
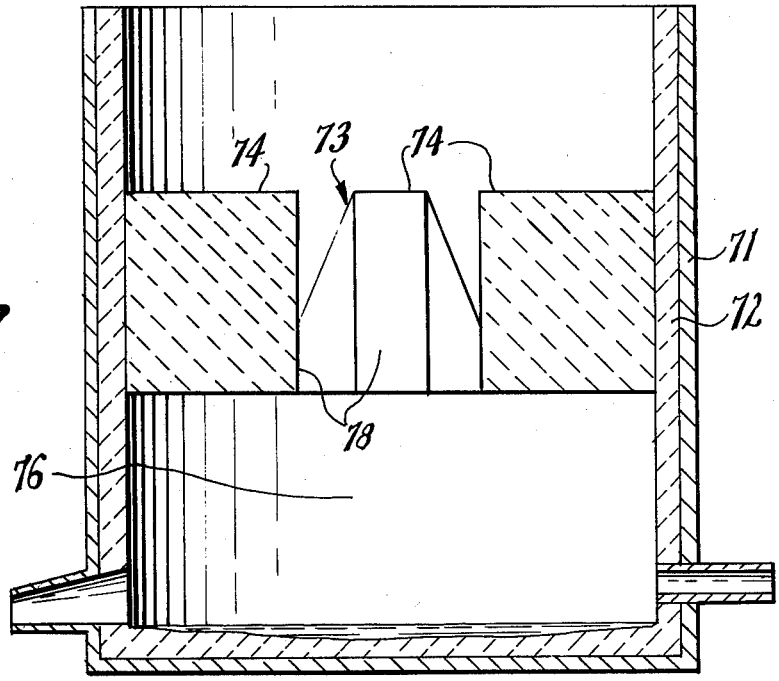
FIG. 7 is a vertical cross-section taken along line 7—7 of FIG. 6.

FIGS. 6 and 7 illustrate an alternative hearth and support structure in accordance with the present invention, wherein the hearth is cylindrical in shape rather than conical. The hearth is composed of a cylindrical metal shell 71, provided with a refractory lining 72, to which there are fixedly attached four support members 73, each of which contain a horizontal top surface 74, and side walls 75 and 75' which taper both outward from the axis toward the wall 72, as well as in a downward direction. The surfaces 78 which face the axis are vertical, consequently the central space 79 which extends through the support structure is cylindrical being generated by a downwardly moving inscribed circle A. As a result of the downward taper of side walls 75 and 75', the diameter of inscribed circle B (which lies in the horizontal plane within each of the peripheral spaces 77 formed by the hearth wall 72 and the side surfaces 75 and 75' of adjacent support members 73) will decrease in the downward direction, causing the peripheral spaces 77 to converge in the downward direction and control the passage of solids into the lower hearth zone 76.

Figure 8:
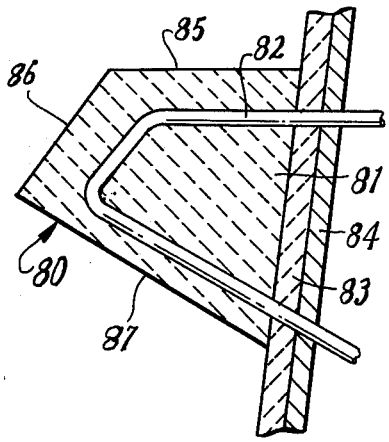
FIG. 8 is a cross-sectional view of an alternative embodiment of a wall mounted support member, the axial face of which is tapered toward the center of the hearth.

FIG. 8 illustrates an alternative embodiment for a support member 80 which may be used in place of those shown in FIGS. 1,4 and 6. Support 80, shown mounted to the refractory lining 83 of the metal hearth shell 84, has a horizontal top surface 85, and a surface 86 facing the axis of the hearth, but which is tapered from the top down toward the axis, and thereafter slopes back along surface 87 toward the hearth wall. By providing a plurality of such hearth support members 80, the space formed in the center of the hearth support structure will have the shape of a converging cone. That is, the surface 86 will tend to direct the flow of pellets toward the center of the support structure and hence into the middle of the lower hearth. Support member 80 is provided with a cooling pipe 82 in order to prevent the refractory support member from being eroded by the harsh conditions of the hearth.

Figure 9:
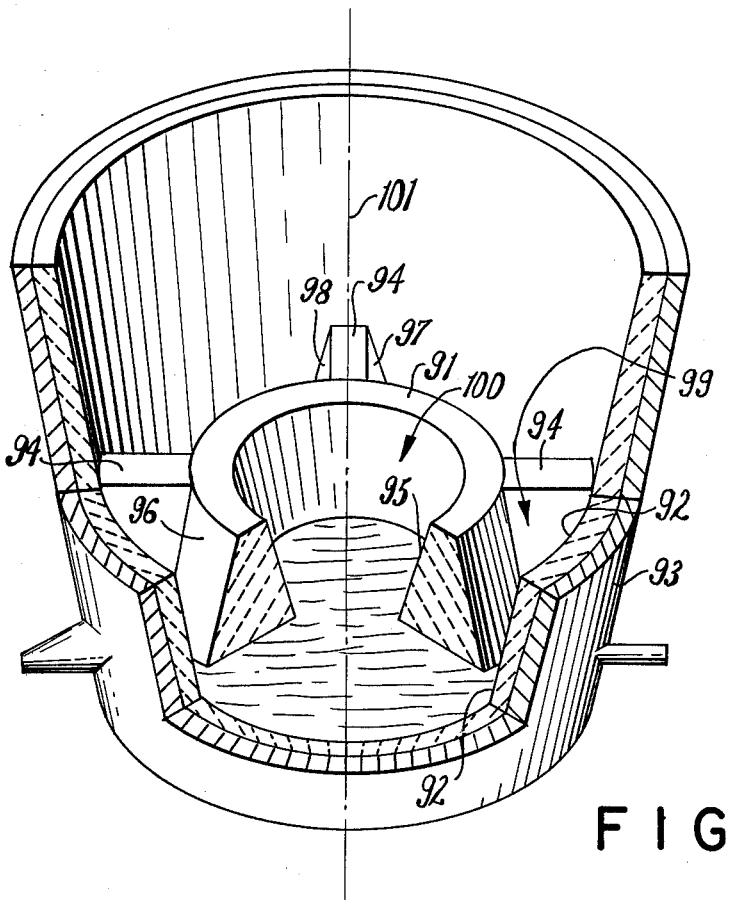
FIG. 9 is an isometric view, partially cut away, illustrating an alternative preferred embodiment of the bed support structure, in accordance with the present invention, which includes a toroidal inner element.

FIG. 9 is an isometric view, partially cut away, illustrating an alternative preferred embodiment of a bed support structure in accordance with the present invention. This embodiment differs from those previously described in that it contains an additional structural element 91 of toroidal shape in the center of the support structure. Element 91 is fixedly attached to four support members 94 (only three are shown) at their axial end. The opposite ends of the support members are fixedly attached to the wall 92 of the hearth 93. Toroidal element 91 is trapezoidal in cross-section, creating a conical interior surface 95 which converges downward, and an outer surface 96 which tapers toward the hearth wall 92. Each of the support members 94 have side walls 97 and 98 which also taper downward. Hence, each group of the four adjacent surfaces 97, 92, 98 and 96 form one of four peripheral downwardly converging spaces 99 which extend through the support structure. The four surfaces which form each peripheral space 99 are a side surface 97 of one support member 94, the inside surface of the hearth wall 92, a side surface 98 of an adjoining support member 94 and the outside surface 96 of the toroidal member 91. It will be seen that the support structure has five downwardly converging spaces, four peripheral spaces 99 and a conical center space 100, all of which extend through the support structure. Such a structure provides a controlled rate of char feed to the hearth, with the char being channeled or directed generally toward the center of the lower hearth.

While not illustrated in FIG. 9, the toroidal member 91 as well as the radial support members 94 are each cooled by the circulation of a cooling medium through piping embedded in the refractory structure in order to keep the structure from being deteriorated by the harsh conditions in the hearth.

EXAMPLE

A shaft furnace as described in U.S. Pat. No. 3,801,082, but having a cylindrical shaft, was modified by the provision of a bed support structure of the design shown in FIG. 4 hereof; i.e. having four short and four long support members with the center space open. The vertical portion of the shaft furnace was approximately 26 feet high and 10 feet in inside diameter, as was the top cross-section of the conical hearth. The hearth, which was approximately 8 feet deep, had the bed support structure fixedly attached to the lower portion of its wall. The top of the bed support structure was approximately 85 inches in diameter and 3 feet above the floor of the hearth, with the lowest extremity of the support structure extending down approximately 30 inches. Hence, the depth of the support structure is slightly over $\frac{1}{3}$ of its diameter. The radial extent of the long support members was 31 inches, while the radial extent of the short members was 24 inches each. The hearth was tapered at an acute angle ($\alpha$ in FIG. 1) of approximately 69° formed by the wall of the hearth and the horizontal plane at the top of the hearth. Each support member was constructed of a commercially available refractory ramming mix, in which there was embedded a nominal 2 inch copper pipe through which cooling water was circulated. Copper fins were attached to the cooling tube in order to increase the rate of heat flux through the refractory, thereby insuring the maintenance of a protective slag skull on the support members.

The shaft furnace was operated with the refuse being charged in the form of pellets having an as-charged dimension of approximately 13 inches in diameter and lengths varying from 6–12 inches. Operating conditions in the furnace were maintained within the ranges specified in U.S. Pat. No. 3,729,298. Operation over a prolonged period of time was satisfactory. There were no significant disruptions such as those associated with collapse of the bed and poor gas mixing. That is, there were no upsets in operating conditions.

The present invention produces a number of important advantages over the prior art. One advantage produced by this invention is that it causes the highest temperatures to be generated in the lower hearth. In the pyrolysis of refuse in accordance with the Anderson process, it is important that the highest temperature be maintained in the lower portion of the hearth in order that the slag remain in a molten condition for tapping. At the same time sufficient heat must also be generated in the lower hearth from combustion of the char, which is the principal source of fuel in the system, to pyrolyze the bed of refuse pellets in the shaft above. This advantage is achieved by selectively letting only the char pass through the support structure. The bed support structure of this invention substantially prevents unpyrolyzed refuse from passing through it. This is important because the combustion of unpyrolyzed pellets if allowed to enter the lower hearth, will produce a significantly lower temperature than will the combustion of char.

Another advantage of the present invention is that it provides for passage of the char into the hearth in a uniformly distributed manner over the horizontal cross-section of the furnace, thereby enabling the bed of refuse pellets to move down through the pyrolysis zone uniformly, helping to maintain a smoothly descending bed devoid of undesirable flow channels. Such a uniform distribution of spaces in the bed also helps to maintain an even flow of hot gases up through the bed, producing a uniform distribution of heat, and uniform substantially complete pyrolysis of the refuse in the bed. In addition, the present invention provides a cavity below the bed support structure and above the pool of molten slag which acts as a gas mixing chamber and has a manifold helping to produce a uniform flow of gas up through the shaft.

What is claimed is:

1. In a vertical shaft furnace for the pyrolysis of pelletized refuse, having a drying zone in the upper part, a pyrolysis zone in the mid portion, and a hearth for combustion and melting in the base of said furnace provided with means for supplying oxygen to said hearth, the improvement comprising a refuse bed support structure, said support structure being located in the lower portion of the hearth but above the level of said oxygen supply means, and comprising at least three cooled, refractory support members, extending radially inward from the hearth wall toward the axis of the hearth and having side wall surfaces, said support structure being characterized by having a plurality of peripheral spaces extending through said structure and converging in the downward direction, each of said peripheral spaces being formed at least in part by the side wall surfaces of adjacent support members and the inside surface of the hearth.

2. The apparatus of claim 1, wherein the diameter of the largest inscribed circle which fits into a horizontal cross-section of said peripheral spaces is smaller than three times the diameter of the refuse pellets charged to the furnace, and wherein the diameter of such inscribed circles decreases in the downward direction.

3. The apparatus of claim 1, wherein said support members terminate short of the axis, so as to form a central space extending through said support structure, the cross-sectional area of said central space in the horizontal plane at the top of the support structure being less than 40% of the total cross-sectional area of the hearth in the same plane.

4. The apparatus of claim 3, wherein the support members are fixedly attached at their axial ends to a cooled, refractory, toroidal structure whose axis is parallel to that of the hearth.

5. The apparatus of claim 4, wherein the surface of said toroidal structure facing its axis is frusto-conically shaped, converging in the downward direction.

6. The apparatus of claim 1, wherein the number of support members is within the range of from 4–16.

7. The apparatus of claim 1, wherein said support members have vertical side surfaces which are parallel to each other.

8. The apparatus of claim 1, wherein said support members have side surfaces which taper from the axis toward the hearth wall such that the support members are wider at the wall than near the axis.

9. The apparatus of claim 1, wherein said support members have side surfaces which taper axially downward, such that the support structures are wider at the bottom than at the top.

10. The apparatus of claim 3, wherein the surface of said support members facing the axis is vertical for a given distance and then tapers away from the axis toward the hearth wall.

11. The apparatus of claim 3, wherein the surface of said support members facing the axis tapers toward the axis, thereby causing the central space to converge in the downward direction.

12. The apparatus of claim 4, wherein said toroidal structure is trapezoidal in cross-section.

* * * * *

UNITED STATES PATENT OFFICE

CERTIFICATE OF CORRECTION

Patent No. 4,077,338 Dated March 7, 1978

Inventor(s) Halvorson et al

It is certified that error appears in the above-identified patent and that said Letters Patent are hereby corrected as shown below:

In the Abstract, line 7, "side" should read -- said --.

In Col. 6, line 63, after "furnace" insert -- such --.

Signed and Sealed this

*Third* Day of *October 1978*

[SEAL]

*Attest:*

RUTH C. MASON
*Attesting Officer*

DONALD W. BANNER
*Commissioner of Patents and Trademarks*